United States Patent [19]

Claringbull

[11] 4,319,784

[45] Mar. 16, 1982

[54] APPARATUS FOR WATER JET AND IMPACT DRILLING AND MINING

[75] Inventor: Peter Claringbull, Kuala Lumpur, Malaysia

[73] Assignee: Conzinc Riotinto Malaysia Sendirian Berhard, Malaysia

[21] Appl. No.: 156,507

[22] Filed: Jun. 4, 1980

[51] Int. Cl.[3] ..... E21C 45/00

[52] U.S. Cl. ..... 299/64; 299/17; 175/67; 175/69; 175/135

[58] Field of Search ..... 299/17, 64; 175/67, 175/69, 135, 172, 422

[56] References Cited

U.S. PATENT DOCUMENTS

| | | | |
|---|---|---|---|
| 2,312,018 | 2/1943 | Beckman | 175/422 X |
| 2,315,496 | 4/1943 | Boynton | 175/422 X |
| 2,720,381 | 10/1955 | Quick | 175/67 X |
| 3,674,100 | 7/1972 | Becker | 175/69 |
| 4,232,752 | 11/1980 | Hauk et al. | 175/171 X |

*Primary Examiner*—Ernest R. Purser

*Attorney, Agent, or Firm*—Bernard, Rothwell & Brown

[57] ABSTRACT

The invention is a novel method and apparatus for subterranean drilling and mining, particularly suited to alluvial deposits. The method uses water jets from the lower end of the apparatus to loosen and remove soil. Part of the water is bled off to raise a piston and associated weight, the water being evacuated from the cylinder in which the piston operates from time to time to give periodic impulses to the outer casing. Air may be admitted to the system during the mining mode to increase its efficiency.

7 Claims, 5 Drawing Figures

APPARATUS FOR WATER JET AND IMPACT DRILLING AND MINING

Figure 1:
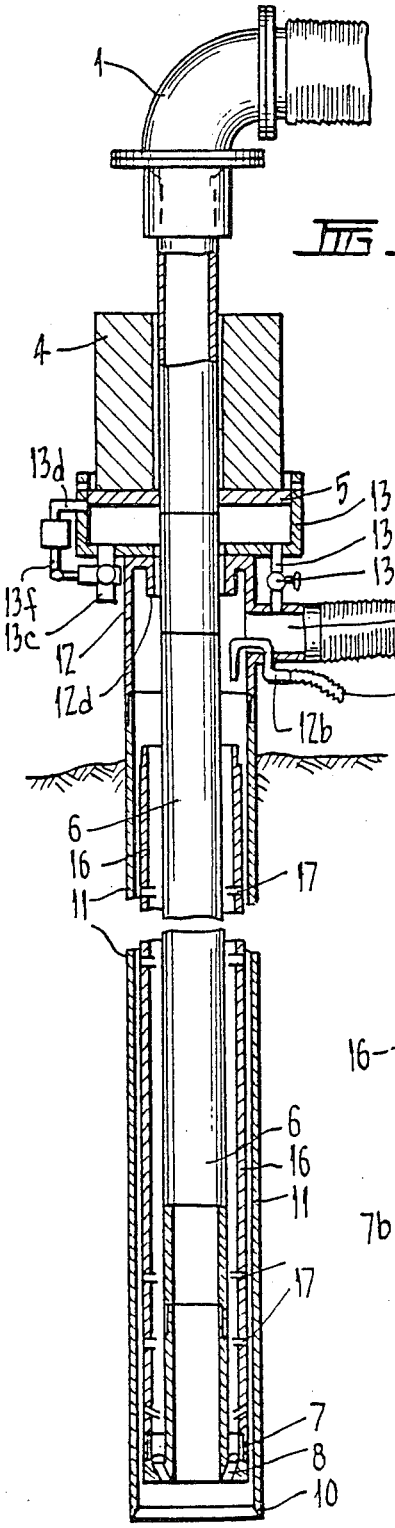

This invention relates to a mining apparatus and method and more particularly to an apparatus and method for mining by the subterranean drilling and slurry system.

Both the apparatus and the method are particularly suited to alluvial mining. While not restricted thereto, the invention is particularly suitable for mining pockets of alluvial tin. In many areas mining of alluvial deposits has been carried out for many years and the high grade ore concentrations have been considerably depleted. Considerable additional reserves of tin ore are known to exist in areas and environments which cannot be mined by conventional means. The conventional means include:

1. Opencast Mining

This method calls for the mineral bearing materials and all barren overburden or barren material strata to be excavated by means of mechanical earthmoving equipment. The barren material is stacked outside the mining area and the mineral bearing material is transported to a processing plant for the recovery of the mineral.

2. Hydraulic, gravel pump mining

This method is similar to opencast mining but in this case the mineral bearing materials and all barren overburden or barren material strata are mined by the action of water jets directed at the face of the excavation. The resulting slurry from the excavation is led to a gravel pump which pumps slurry to a processing plant for the recovery of minerals.

A combination of opencase mining and hydraulic, gravel pump mining may be used to advantage in some types of alluvial deposits.

3. Dredging

For offshore and onshore deposits located in a favourable environment bucket or suction dredges may be used.

These mining methods are effective in excavating large volumes of material at relatively low cost but as a means of alluvial mining they have several shortcomings.

(a) Total Removal of Materials

In all cases the total depth of alluvium to a depth equivalent to the lower limit of the mineral bearing strata has to be removed to form in the case of 1 and 2 an open excavation, and in case 3 a water filled excavation. Hence these methods offer no means of vertical mining selectivity with a result that large volumes of barren material are removed in order that the mineral bearing stratas may be mined.

(b) Restricted Depth

Methods 1 and 2 are rarely effective in mining to depths of greater than 100′ below surface owing to slope stability, water inflow and cost escalation problems. The most modern dredges are able to dredge to depths of 150 feet below paddock water level. To dredge below this depth necessitates the lowering of the paddlock water level which in turn induces similar problems to those encountered in methods 1 and 2.

(c) The procedure of establishing a mining excavation for any of the methods is both time-consuming and costly. Hence in deposits which contain high grade areas separated by areas of lesser grade it is invariably necessary to establish the mining operation in the most cost effective areas and progressively mine the remainder of the deposits on a predetermined course which will include, from necessity, the low grade areas. Because of this lack of horizontal selectivity these methods can only be applied to areas whose overall average grade is considered economic as they are unable to selectively mine relatively small areas of economic or better grade from within a larger area of less than economic grade.

(d) Capital Costs

Dredging operations require very high capital investment but provide the means of moving material at relatively low unit costs. This factor, in conjunction with (b) above necessitates that inland dredging is only applicable to deposits of large area (approximately 1,000 acres or more).

Opencast and gravel pump mines require less capital expenditure but are subject to lower throughput at higher unit costs. Hence these types of operation are normally employed in shallower deposits of smaller area (+50 acres) but with a higher overall grade.

(e) All these methods tend to be labour intensive.

(f) The economic viability of these methods is largely based on the evaluation of the deposit by borehole sampling. Owing to the very small volume of sample taken from the boreholes in relation to the overall volume of the deposit it is possible to have very wide discrepancies between the borehole evaluation and the actual mined recovery from an area.

(g) All the above methods involve the complete disruption of the surface of the area mined. The rehabilitation of the mined areas is difficult and costly and is rarely effected to a satisfactory level, with the result that large areas of sandy tailings generated by alluvial mining activities remain as environmental scars.

(h) The invention is also particularly applicable to alluvial deposits which may be mined by the traditional shaft and/or tunnelling methods. Here it will also be less expensive as well as being able to be used where shaft construction or tunnelling is difficult or impossible because of excessive amounts of water or hazards due to the physical nature of the ground.

Considerable additional reserves of tin ore are known to exist in areas and environments which cannot be mined by conventional means. These reserves may be characterised broadly as follows:

- Reserves lying beneath previously mined areas where the mining method used was incapable of reaching the lower limit of the ore deposit.
- Unmined areas where tin bearing material is overlain by such a thickness as to make the deposit uneconomic to present mining methods.
- Unmined areas where the depth of the deposit is too great for present mining methods.
- Deposits which are too small in volume to be mined by present methods.
- Deposits or remnants of deposits which have not been mined owing to geological or environmental restrictions e.g. the presence of rivers, agricultural activities, towns etc.

The main object of this invention is to provide mining apparatus for use in alluvial conditions which will permit greater horizontal and vertical selectivity than has previously been possible.

It is a further object of the invention to provide drilling and mining apparatus which will enable previously uneconomic mineral deposits to be mined economically.

It is a further object of the invention to provide improved methods of subterranean drilling and mining which have particular application in alluvial deposits.

With these objects in view, the invention provides a method of subterranean drilling comprising the steps of:

feeding water under pressure to the annular space between a casing pipe and an inner pipe, allowing the water to pass out of the lower end of the annular space at high velocity through a plurality of jet apertures directed against the working face of the drill hole, applying periodic impacts to the casing pipe to assist it to penetrate the strata, and removing the water and spoil through the inner pipe.

The invention also provides apparatus for subterranean drilling comprising:

a cylindrical casing pipe, a cylindrical inner pipe arranged within, but not attached to, said casing pipe, and which is free to move therein in a vertical direction and/or to rotate within it, a cutting shoe attached to the lower end of said inner pipe, said cutting shoe having an external diameter which is a sliding fit within said casing pipe, a plurality of drilling jets formed through said cutting shoe, means to admit water under pressure to the annular space between the casing pipe and the inner pipe, and means to apply periodic impacts to said casing pipe to assist it to penetrate the strata.

The invention further provides a method of mining comprising the steps of:

forming a drill hole through overburden down to a mineral-bearing stratum, lining said drill hole with a casing pipe, passing an inner pipe and an intermediate pipe through said casing pipe, feeding water and air under pressure to the annular space between the inner pipe and the intermediate pipe, allowing the water and air to pass out of the intermediate pipe through a mining nozzle arranged at the bottom of the inner and intermediate pipes, and removing the water, air and spoil through the inner pipe.

The invention also provides mining apparatus comprising:

a cylindrical casing pipe, a cylindrical intermediate pipe arranged within, but not attached to, said casing pipe, and which is free to move therein in a vertical direction and/or to rotate within it, a cylindrical inner pipe arranged within and connected to said intermediate pipe, at least one mining nozzle in the wall of said intermediate pipe, means to admit air and water under pressure to the annular space between the intermediate pipe and the inner pipe.

Figure 2:
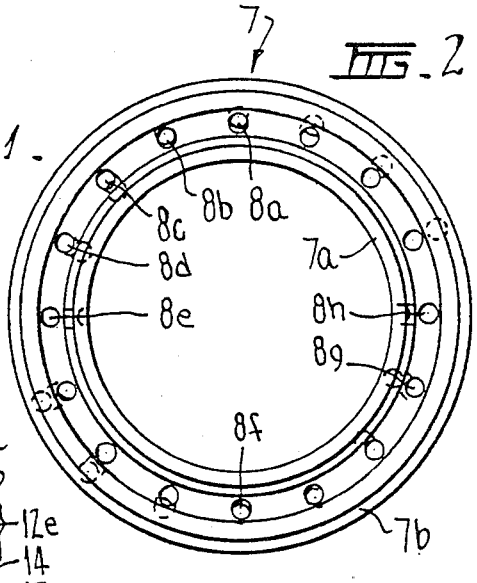
Figure 3:
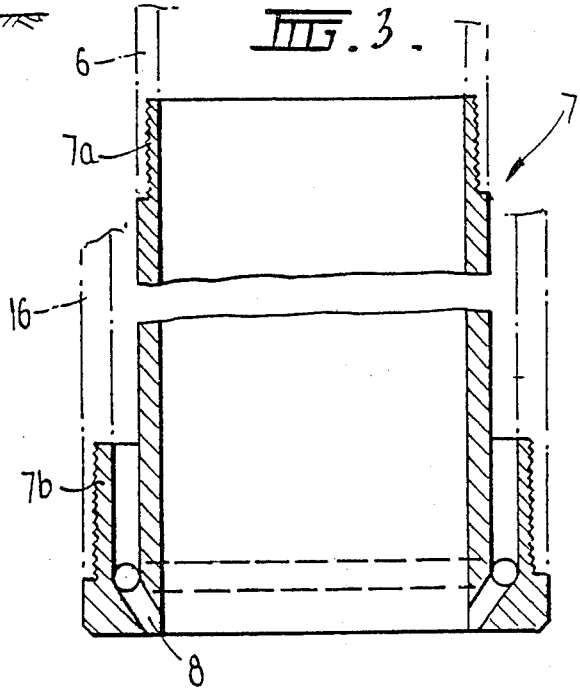
Figure 4:
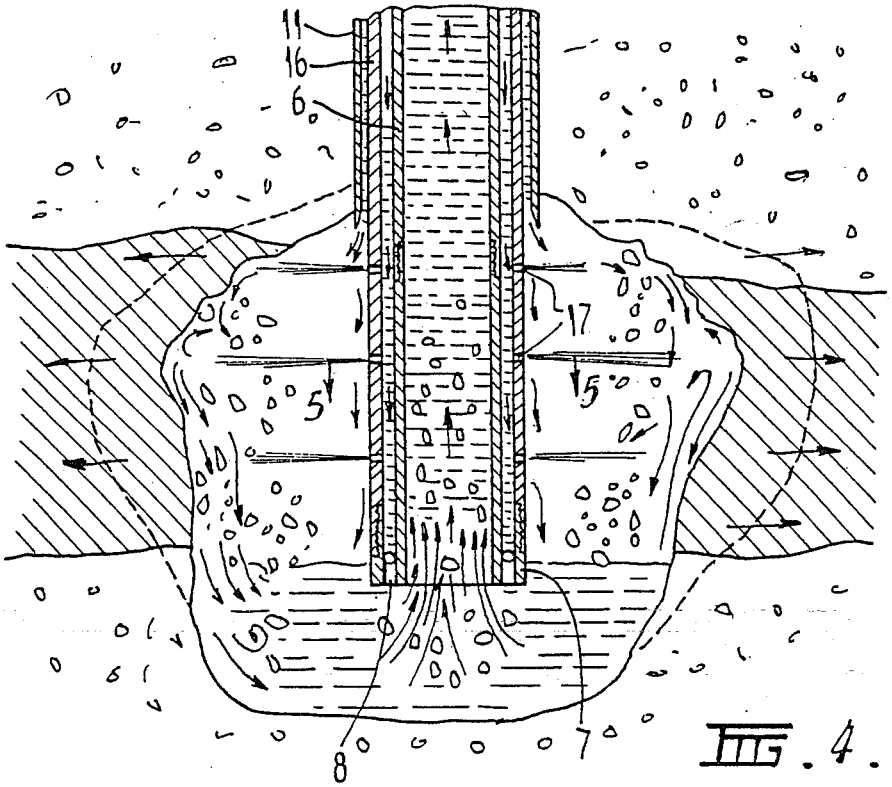
Figure 5:
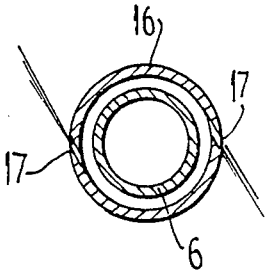

In order that the invention may be more readily understood it will now be described by way of example with reference to the accompanying drawings in which:

FIG. 1 is a diagrammatic representation of the apparatus according to the invention, FIG. 2 is a plan view of a drilling jet cutting shoe forming part of the apparatus illustrated in FIG. 1, FIG. 3 is a cross-sectional view of the drilling jet cutting shoe, FIG. 4 is a diagrammatic cross-sectional view of a mining apparatus in operation, FIG. 5 is a cross-sectional view of the apparatus on line 5—5 of FIG. 4.

The apparatus has an inner pipe 6 at the upper end of which there is a swivel connection, by means of which a pipe bend 1 is rotatably connected to the inner pipe 6. Pipe bend 1 has an internal diameter which is greater than that of the inner pipe 6 to allow the passage of large pieces of material without blocking the bend. The other end of pipe bend 1 has connected to it a flexible discharge pipe by means of which material removed by the apparatus is conveyed to a mobile treatment plant or to a pumping facility.

The lower end of inner pipe 6 has attached to it a drilling jet cutting shoe 7 which is illustrated in some detail in FIGS. 2 and 3.

The cutting shoe 7 is formed with an inner ring 7*a* and an outer ring 7*b* by means of which it can be attached to an inner pipe 6 and/or an intermediate pipe 16 respectively. Ring 7*a* has inner and outer diameters equal to the inner and outer diameters of inner pipe 6 and is screw threaded at its upper end for connection to the inner pipe. Ring 7*b* has inner and outer diameters equal to the inner and outer diameters of intermediate pipe 16 and is screw threaded on its outer surface for connection to the lower end of the intermediate pipe.

Both the inner pipe 6 and the intermediate pipe 16 are made up of a variable number of pipe lengths depending on the depth requirements of the drilling/mining operation. The pipe lengths are connected by flush integral screw connections.

Drilling jets 8 are formed in the base of the shoe. The jets all connect into the annular space between ring 7*a* and ring 7*b* but may be of different sizes, configurations and angles to provide the most suitable cutting characteristics. One suitable pattern for the jets is shown in FIG. 2 in which it can be seen that jet 8*a* is substantially vertical, jet 8*b* is directed slightly radially outwardly, jet 8*c* is directed a little more radially outwardly, jet 8*d* has a maximum outward inclination, jet 8*e* has maximum inward inclination, jet 8*f* is again substantially vertical, jet 8*g* has maximum outward inclination and jet 8*h* has maximum inward inclination.

The intermediate pipe is surrounded by a casing 11 in which intermediate pipe 16 and cutting shoe 7 are fitted with sufficient clearance to enable intermediate pipe 16 to slide relative to the casing 11. The lower end of casing 11 is provided with a casing cutting shoe 10. This cutting shoe may be of any suitable configuration for example, serrated, toothed or plain round depending on the nature of the ground to be drilled. The lower edge is hardened and sharpened to provide good wear and cutting characteristics.

The upper end of casing 11 is connected to a pressure head 12 and a seal is formed between the inner pipe 6 and the pressure head as indicated at 12*d*. The pressure head 12 is provided with an inlet 12*e* to which is connected a flexible water pipe 14 for the supply of water under pressure from a conventional pumping facility. Above pressure head 12 there is arranged an impact cylinder 13 in which an impact piston 5 is mounted for vertical movement. A detachable drilling weight 4 is supported by impact piston 5. Impact cylinder 13 is fitted with an inlet 13*a* controlled by a regulating valve 13*b* to admit water and/or air into the cylinder from the pressure head 12. Pressure head 12 is also provided with an air inlet 12*b* to which a flexible air hose 15 is connected to admit compressed air from a conventional air compressor.

The outer limit of travel of impact piston 5 is determined by a series of control valve outlets arranged at different heights. Only one such outlet is illustrated in the drawing at 13*d*. In operation of the equipment, any one of these outlets may be selected to provide the most effective length of piston stroke. Cylinder 13 is also provided with a pre-selected number of cylinder evacuating valves 13*c* connected by suitable linkage 13*f* to a control valve which is actuated by the water/air from the impact cylinder.

Intermediate pipe 16 is provided with a number of sets of mining nozzles 17 at pre-selected spacing. The nozzles, the inner ends of which project into the annular space between the intermediate and inner pipes, are formed to provide jets of water/air which pass through openings in the intermediate pipe wall. The jets are arranged substantially tangentially to the circumference of the intermediate pipe.

The operation of the equipment is as follows:

(a) Drilling

Water under pressure is admitted to pressure head 12 through flexible hose 14. The water flows down through the annular space between the inner and intermediate pipes and passes out through the drilling jets 8 in cutting shoe 7. The force of the jets breaks up the material immediately below the casing 11.

At the same time water can be admitted through regulating valve 13*b* to impact cylinder 13 to raise piston 5 and drilling weight 4. When the piston has risen to a height sufficient to cover the selected control valve outlet 13*d*, water flows through the outlet to control valve 13*e* which is actuated to open the cylinder evacuating valves 13*c* so causing the impact piston 5 and weight 4 to fall. The falling of piston 5 past control valve outlet 13*d* discharges the control valve actuating pressure to atmosphere and the evacuating valves are returned to the closed position.

This process is continued automatically to provide a periodic impact to the casing 11 to cause it to penetrate the alluvium. The inner pipe 6 may be rotated during the drilling operation to enable the jets 8 to work more effectively. The cutting shoe 7 is preferably retained within casing 11 during the drilling operation so that the diameter of the drilled hole remains the same as the external diameter of the casing 11 and the casing is a tight fit within the hole. For some purposes a larger diameter hole may be required and in this case the cutting shoe is lowered until it extends beyond the end of the casing 11.

The water and the spoil removed by the jets are removed from the bore hole through inner pipe 6.

(b) Mining

If the depth of the stratum to be mined is known, the cased borehole is sunk to the upper limit of the stratum using the drilling technique described above. The pipe bend 1 at the top of the inner pipe 6 is then connected by means of flexible pipe to a mobile treatment plant either directly or via a pumping facility. Regulating valve 13 is closed to prevent further impacts on the casing 11. The casing is held stationary and the inner pipe 6 is extended beyond the end of the casing. This is best seen in FIG. 4. The inner pipe 6 is extended until the drilling jet cutting shoe 7 reaches the lower limit of the stratum to be mined. The drilling jets 8 may be closed by introducing ball bearings into the apparatus through flexible hose 14 and allowing them to drop through the annular space between the inner and intermediate pipes to seal the nozzles 8. Preferably not all of the nozzles 8 are sealed, a small number for example 2, being left unsealed to assist in the advance of the cutting shoe 7 through the stratum to be mined. This is achieved by having the jets which are not to be sealed extending up into the annulus and/or by placing bars across their upper ends to deflect the ball bearings. These jets are preferably of larger diameter than the other jets.

The equipment is now in the mining mode.

During the mining operation the inner pipe string 6 and the cutting shoe 7 are rotated from the surface either manually or mechanically to allow the mining jets 17 to mine over the full circumference of the mining chamber. Throughout the operation some compressed air may be fed into the mining chamber mixed with the water via flexible hose 15 and the mining nozzles 17 to enable the mining jets to operate in an air environment to increase their mining efficiency. Excess air supply discharges up the inner pipe 6 and assists in the transportation of mined materials to surface.

The initial stages of the development of the mining chamber can be seen in FIG. 4. In suitable deposits, mining chambers up to six meters and more in diameter may be formed before it becomes necessary to withdraw and relocate the apparatus.

Hence the mining operation takes place in a pressurised chamber. This pressurisation counteracts the tendency for the mining chamber to collapse and also enables the mining and transportation of the mined materials to the surface to be affected without any additional equipment.

On completion of mining operations from a borehole the mining chamber is filled with water and the inner pipe is removed to leave a cased hole.

The water level in the cased hole may be maintained at a higher level than the surrounding water table to provide a positive pressure within the chamber to stabilise the chamber walls and prevent collapse. The chamber should then be backfilled preferably using tailings from the mining operation.

On completion of the back filling operation the casing pipes are withdrawn using conventional means.

ADVANTAGES OF THE DRILLING METHOD (1) The drilling impact mechanism provides for the intensity and frequency of the impact to be varied over a large range without equipment modification by utilising one or more of the following variables:

(a) Increasing/decreasing the stroke of the impact cylinder by any of a number of control valve outlet locations.

(b) Increasing/reducing the rate of flow of water (air) into the impact cylinder by adjusting the inlet valve.

(c) Increasing/reducing the weight of the impact hammer by varying the detachable weight.

(d) Increasing/decreasing the rate for flow from the impact cylinder evacuation valves.

(e) Increasing/decreasing the impact frequency by adjusting the control valve. By using the above flexibility the most effective and efficient impact force can be selected during the drilling operation for optimum penetration of various geological strata encountered.

(2) Low capital and operating costs.

(a) The system uses single wall pipes which are relatively inexpensive in relation to dual wall pipes currently used in the drilling industry.

(b) The impact mechanism is of very low cost, consisting only of the impact piston, impact cylinder, detachable weight and the various valves.

(c) The system may be incorporated into a mobile drilling rig or it may be operated independently from such a rig by using a mobile crane or lifting gantry to assist with rod changes. For smaller units the operation can be accomplished by using manpower only with no loss of efficiency except in the time taken to change drill pipes and casings.

(d) The only power used during the operation is that of a water pump and/or air compressor. The water/air being used to mine the borehole material, elevate the borehole material to surface, and also provide the necessary energy to produce the required impact.

(e) The method, apart from the cranage, water pump and/or air compressor, and valves has only one moving part i.e. the inner pipe string, and as a result has low operating maintenance costs.

(3) Variable material recovery depending on requirement.

By varying the distance of the drilling jets from the casing shoe it is possible to vary the drilling characteristics depending on the requirements of the operation.

If fast penetration is required in a hole or through a particular geological stratum within a hole and accurate mineral sampling is not required the drilling jet shoe may be extended, by using an appropriate inner pipe string make-up piece, to a position near to, or even below the casing cutting shoe. In this position the drilling jets excavate the ground ahead of the casing cutting shoe and to some extent outside the circumference of the shoe. This has the effect of increasing the penetration rate of the casing.

If accurate mineral samples are required it is preferable to position the drilling jet shoe at a point some distance above the casing shoe so that the jets only act on material which has entered the casing by the impact action. This practice will reduce the penetration rate as the casing cutting shoe is in this case being penetrated into undisturbed ground.

(4) If a hole is obstructed by materials which are too hard to permit penetration, the obstructing material, e.g. boulders, may be broken up by conventional rotary and/or percussion drilling through the inner pipe or if necessary through the casing after removal of the inner pipe.

(5) On completion of drilling the inner pipe string may be removed to leave a cased hole or the casing may be pulled in a conventional manner.

(6) The basic principles of the invention are equally suitable for boreholes of large or small diameter.

(7) The method is eminently suitable for application with the mining system of this invention, the only additional components required being the mining head middle pipe sections incorporating the mining jets. Provided that the middle pipe sections are added during the drilling operation the mining operation carries on continuously after the driving of the casing has been completed by the drilling method.

ADVANTAGES OF MINING TECHNIQUE

The mining technique has the following advantages over existing alluvial mining techniques.

(1) Vertical Selectivity of mined material. The technique enables the operator to mine a selected stratum or strata of economic interest without mining the overlying or interceding strata of barren or sub-economic grade of material.

(2) Horizontal Selectivity of materials mined. Owing to the mobile nature of the drilling/mining equipment it is possible to mine isolated pockets of economic materials without jeopardising the financial viability of the project.

(3) Mining depth. The depth potential of the drilling/-mining system is in excess of current mining systems.

(4) The system is adaptable to both onshore and offshore mining conditions.

(5) Tailings produced by the mining operation may be returned to the mining cavity.

(6) The method creates the minimum of environmental disturbance.

(7) When compared with present mining methods, the method of this invention requires a very low capital investment, and operating costs per unit of mineral recovered are also very low.

(8) The method has a low man-power requirement and calls for less manpower skills than present methods.

(9) The selection and mining of material of economic grade from within a deposit of overall lower grade in no way negates the possibility of mining the lower grade unmined areas at a future date should it be so desired.

In addition to its mining application, it is possible that the system may find usage in:

(a) The civil engineering industry for:

(i) the driving of tubular piles and caissons (ii) structural foundations and structural anchors.

(b) Water well industry for the drilling and chambering of water supply wells.

(c) The oil industry for the underwater anchoring of offshore equipment.

(d) The drilling industry in situations where a cased hole is required through unconsolidated alluvium or decomposed rock to enable hardrock drilling into the basement rock to take place via the cased hole unhindered by the unconsolidated material.

(e) The building industry for the supply of building sand and aggregate from subterranean strata in the locality of the building site.

(f) Manufacturing industry as a means of providing underground chambers for the disposal of industrial waste materials.

It should be noted that, if the apparatus of the invention is being used only for a drilling operation and not for mining, then the intermediate pipe 16 may be dispensed with.

I claim:

1. Subterranean drilling and mining apparatus, comprising a cylindrical casing pipe to line a borehole to be formed by the apparatus;

an inner drill string assembly movable vertically within the casing pipe and comprising an inner pipe, an intermediate pipe which is slidable in the outer casing pipe and which encompasses the inner pipe so as to define an annular clearance space between it and the inner pipe, and a drilling shoe interconnecting the bottom ends of the inner pipe and the intermediate pipe and formed with a plurality of drilling jet passages communicating with said annular clearance space;

mining jet means comprising at least one mining nozzle extending through the wall of the intermediate pipe above the drilling shoe;

water inlet means for admitting water under pressure to the annular clearance space between the intermediate pipe and the main pipe; and impact means for delivering impact blows to the casing pipe to drill and case a borehole by operation of the impact means to drive the casing pipe downwardly while maintaining the inner drill string assembly retracted therein sufficiently to maintain said mining jet means within the casing pipe, means for supplying water under pressure via the water inlet means to the annular clearance space between the intermediate pipe and the inner pipe to issue therefrom through the drilling jet passages as drilling jets to assist penetration of the casing pipe and means for extending the inner drill string assembly downwardly within the casing pipe to bring the mining jet means beneath the bottom end of the casing pipe to allow water under pressure to issue therethrough as at least one mining jet effective to excavate the material to be mined, the inner pipe serving as an extraction pipe for extraction of expended water and spoil during both drilling and mining operations to mine material surrounding the bottom of the bore hole.

2. Apparatus as claimed in claim 1, wherein said mining nozzle is one of a plurality of such nozzles forming said mining jet means and disposed in an array spreading circumferentially and vertically of the intermediate pipe.

3. Apparatus as claimed in claim 2, wherein the inner drill string assembly is rotatable within the outer casing pipe to provide rotating cutting jets during drilling and rotating mining jets during mining.

4. Apparatus as claimed in claim 2, comprising air inlet means for admitting compressed air to said annular space between the intermediate pipe and the inner pipe for entrainment with the mining jet issuing from said mining jet means during mining to assist excavation and to pressurize the resulting excavation chamber.

5. Apparatus as claimed in claim 2, wherein the upper end of the casing pipe is provided with an end closure through which the inner pipe slidably extends and the upper end of the intermediate pipe terminates beneath this end closure whereby there is formed within the upper end of the casing pipe a chamber connecting with said annular clearance space between the intermediate pipe and the inner pipe, the water inlet means comprises a water inlet duct connecting with said chamber, and there is further provided air inlet means to introduce compressed air into said chamber.

6. Apparatus as claimed in claim 1, wherein at least some of the drilling jet passages are formed in the drilling shoe such that they can be blocked by introduction of freely movable blocking elements into water supplied to said clearance space between the intermediate pipe and the inner pipe.

7. Apparatus as claimed in claim 1, wherein the impact means comprises a structure mounted on the upper end of the casing pipe and defining an annular piston chamber surrounding the inner pipe, a weighted annular piston slidable in the piston chamber, and means for admitting water under pressure to the piston chamber so as to raise the weighted piston and periodically to relieve water from the piston chamber to allow the weighted piston to fall against said structure.

* * * * *